US010994321B2

(12) United States Patent
Avrillaud et al.

(10) Patent No.: US 10,994,321 B2
(45) Date of Patent: May 4, 2021

(54) METHOD FOR ELECTROHYDRAULIC FORMING AND ASSOCIATED DEVICE

(71) Applicant: ADM28 S.ÀR.L, Luxembourg (LU)

(72) Inventors: Gilles Avrillaud, Pinsaguel (FR); Romain Mercier, Moissac (FR)

(73) Assignee: ADM28 S.ÀR.L, Luxembourg (LU)

( * ) Notice: Subject to any disclaimer, the term of this patent is extended or adjusted under 35 U.S.C. 154(b) by 212 days.

(21) Appl. No.: 16/349,962

(22) PCT Filed: Nov. 14, 2017

(86) PCT No.: PCT/EP2017/079236
§ 371 (c)(1),
(2) Date: May 14, 2019

(87) PCT Pub. No.: WO2018/091481
PCT Pub. Date: May 24, 2018

(65) Prior Publication Data

US 2019/0283102 A1 Sep. 19, 2019

(30) Foreign Application Priority Data

Nov. 15, 2016 (FR) ..... 1661068

(51) Int. Cl.
*B21D 26/12* (2006.01)
*B21D 26/023* (2011.01)
*B21D 26/021* (2011.01)

(52) U.S. Cl.
CPC ..... *B21D 26/12* (2013.01); *B21D 26/021* (2013.01); *B21D 26/023* (2013.01)

(58) Field of Classification Search
CPC ..... B21D 26/12; B21D 26/06; B21D 26/08; B21D 24/08; B21D 24/14
USPC ..... 72/56; 29/421.2
See application file for complete search history.

(56) References Cited

U.S. PATENT DOCUMENTS 7,802,457 B2 * 9/2010 Golovashchenko ..... B21D 26/021 72/56
7,827,838 B2 * 11/2010 Golovashchenko ... B21D 26/12 72/56
8,844,331 B2 9/2014 Golovashchenko
(Continued)

FOREIGN PATENT DOCUMENTS

CN 101829732 A 4/2010
DE 10019594 A1 * 10/2001 ..... B21D 26/02
DE 10019594 A1 10/2001

OTHER PUBLICATIONS

Volk, Translation of DE-10019594-A1 (Year: 2001).*

*Primary Examiner* — Adam J Eiseman
*Assistant Examiner* — Bobby Yeonjin Kim
(74) *Attorney, Agent, or Firm* — Seed Intellectual Property Law Group LLP

(57) ABSTRACT

A method for electrohydraulic forming a material blank includes: a material blank to be shaped is placed between a mould and a blank holder; a tight cavity containing electrodes is filled with liquid up to a predetermined liquid level; the material blank is brought into contact with the liquid of the cavity; the material blank is hydraulically preformed; and the material blank is electrohydraulically formed. The liquid of the cavity is pressurised for the hydraulic preforming by moving all or part of one of the walls of the cavity.

14 Claims, 3 Drawing Sheets

(56) References Cited

U.S. PATENT DOCUMENTS

| | | | | |
|---|---|---|---|---|
| 9,375,775 | B2 * | 6/2016 | Golovashchenko ... | B21D 26/02<br>72/54 |
| 9,943,900 | B2 * | 4/2018 | Golovashchenko ... | B21D 26/12<br>72/54 |
| 10,201,843 | B2 | 2/2019 | Avrillaud | |
| 2011/0088442 | A1 * | 4/2011 | Golovashchenko ... | B21D 26/12<br>72/60 |
| 2012/0103045 | A1 * | 5/2012 | Golovashchenko ..... | B21D 26/021<br>72/60 |
| 2018/0015522 | A1 * | 1/2018 | Niaraki ..... | B21D 26/14 |

* cited by examiner

METHOD FOR ELECTROHYDRAULIC FORMING AND ASSOCIATED DEVICE

BACKGROUND OF THE INVENTION

The present invention relates to a method and a device for electrohydraulic forming.

PURPOSE AND SUMMARY OF THE INVENTION

Electrohydraulic forming is used to deform a blank of material against a mould by applying a dynamic pressure. For this purpose, an electric discharge is generated between at least two electrodes in a cavity filled with liquid, for example water. An electric arc is thus formed between the two electrodes resulting in an elevated temperature gradient and vaporisation of the liquid. A pressure wave, commonly referred to as a "shock wave", moves at a high speed and presses the blank of material against the mould. Electrohydraulic forming is particularly advantageous compared to other forming methods since it produces a reduced springback and procures engraving type details and/or sharp edges and/or improved elongations at break on the parts to be formed.

In some cases, in particular when the parts to be formed are particularly deep, a plurality of successive electric discharges are produced.

In order to reduce the number of successive electric discharges required and thus limit the time required to form a part, a hydraulic preforming step has been proposed, to be carried out before the electrohydraulic forming of the part. For this purpose, the cavity is filled with pressurised liquid as disclosed, for example, in the patent document U.S. Pat. No. 7,802,457 B2. When the pressure of the liquid is sufficient, the blank of material is partially deformed against the mould. Electric discharges are then generated in order to produce shock waves and complete the forming of the part until the desired shape is achieved. The preforming of the part by applying quasi-static pressure facilitates the pressing of the blank of material into the mould, thus reduces the deformation of the material to be produced by electrohydraulic forming and thus reduces the forming time in cases wherein the high-voltage electric pulse generator must be recharged between two discharges or reduces the size of the generator in the case wherein the successive discharges are to be carried out without waiting for the generator to recharge between discharges. In such a case, different charged modules are used simultaneously, but activated one after another. In such a case, the electric generator investment is lower since fewer modules can be used.

Such a method has certain drawbacks. The time required to fill the cavity with the pressurised water can be relatively long, in particular when using a pump with a limited flow rate. Moreover, between each cycle for forming a new part, the cavity must be refilled with liquid and pressurised by a pump, which increases the time required to form the part.

The present invention in particular aims to overcome the aforementioned drawbacks of the prior art.

To this end, the present invention proposes, according to a first aspect, a method for electrohydraulically forming a blank of material wherein:

- a blank of material to be deformed is placed between a mould and a blank holder,
- a sealed cavity containing electrodes is filled with liquid to a predetermined liquid level,

- the blank of material is placed in contact with the liquid in the cavity,
- the blank of material is hydraulically preformed, whereby the blank of material is pushed towards the mould by the liquid in the pressurised cavity, thus undergoing a first deformation,
- the blank of material is electrohydraulically formed, whereby the blank of material is pressed against the mould by at least one pressure wave generated by an electric discharge between at least two electrodes, thus undergoing a second deformation.

According to the method of the invention, the liquid in the cavity is pressurised for the hydraulic preforming operation by displacing all or part of one of the walls of the cavity.

In this way, the pressurised cavity can be filled with liquid more quickly than when using a pressurised pump with a limited flow rate. This results in reduced cycle times. Moreover, the equipment to be used is less complex as there is no need to generate pressurised water.

Advantageously, a vacuum is created between the blank of material and the mould after the blank of material is placed in contact with the liquid in the cavity in order to improve the efficiency of the hydraulic and electrohydraulic forming operations.

Moreover, by creating a vacuum in the cavity when filling the cavity with liquid, the filling of the vessel is facilitated and the presence of air at the interface between the liquid and the mould is prevented, which further boosts the efficiency of the hydraulic and electrohydraulic forming operations. It should be noted that other means can be used to prevent the presence of air between the liquid in the cavity and the blank of material to be deformed.

In one embodiment, the liquid in the cavity is pressurised by moving the assembly formed by the mould and the blank of material towards the interior of the cavity.

The blank of material is thus held against the mould by the blank holder and the entire blank of material moves at the same time as the mould towards the interior of the cavity and thus moves closer to the electrodes. The mould is thus mounted on the plate of a press in order to provide the pressure required for the hydraulic preforming operation.

If a wall of the cavity supporting at least one of the electrodes is also capable of moving, the mould and this wall can be mounted on a press with a twofold effect. In such a case, the first effect can be used by the movable wall supporting at least two electrodes in order to pressurise the liquid present in the cavity. The second effect can be used by the mould to adjust the pressure exerted on the blank of material.

In one embodiment, the assembly formed by the mould and the blank of material is moved while the electrodes are stationary.

If the wall that supports the electrodes is stationary, there is no need to move the current-carrying conductors connecting the electrodes to the pulse voltage generator, in which circulate currents of about several tens or hundreds of kA. These current-carrying conductors are therefore heavy, bulky and tend to deteriorate from being moved repeatedly.

Optionally, the assembly formed by the blank of material and the mould can be brought closer to the electrodes between each electric discharge. This increases the efficiency of the forming operation and reduces the volume of water to be used.

In one embodiment, the liquid in the cavity is pressurised by moving one wall comprising the electrodes towards the interior of the cavity.

Moreover, the present invention proposes, according to a second aspect, a device for electrohydraulically forming a blank of material, comprising:

a frame, a sealed cavity capable of being filled with a liquid, one of the walls whereof comprises the blank of material, at least two electrodes placed inside the cavity, a mould, a blank holder capable of holding the blank of material against the mould.

Furthermore, the cavity comprises at least one movable wall, and the movement of the movable wall is capable of pressurising the liquid in the cavity to a sufficient degree to generate a deformation of the blank of material against the mould.

With the device of the invention, there is no need to use a pressurised pump to pressurise the liquid. Such a pump is expensive and increases the complexity of the device. Moreover, the flow rate of such a pump is limited, thus slowing down the pressurisation of the vessel. Furthermore, since the pressurisation of the liquid takes place after moving a movable wall, there is no need to refill the cavity with liquid between each new part forming cycle.

Moreover, the device comprises a vacuum pump.

Preferentially, the electrohydraulic forming device comprises a vacuum pump.

The vacuum pump creates the vacuum between the mould and the blank of material and increases the efficiency of the hydraulic and electrohydraulic forming operations. The vacuum pump can also be used to create the vacuum inside the cavity when filling the vessel. This prevents the presence of air between the blank of material and the liquid in the cavity, which also increases the efficiency of the hydraulic and electrohydraulic forming operations.

In one embodiment, the cavity is at least partly formed by the frame.

If the cavity is partially formed inside the frame, the device is less complex and less bulky.

In one embodiment, the at least two electrodes are supported by a baseplate resting on a bottom wall of the frame.

This reduces the size of the cavity and the volume of liquid required to fill said cavity.

In one embodiment, the blank holder is separate from the frame, and extends longitudinally in the frame towards the electrodes and preferentially at least partly surrounds the electrodes.

The blank holder acts as a reflector and prevents the shock waves from propagating towards the walls of the cavity or of the frame and prevents the deterioration thereof, in particular at the welds if comprising a mechanically welded structure.

In one embodiment, the movable wall comprises the blank of material, and the assembly formed by the mould and the blank of material is mounted on a movable plate of a press.

The assembly formed by the blank of material and the mould can therefore move inside the cavity and towards the interior of the cavity in order to pressurise the liquid present in the cavity. Thus, the blank of material is moved towards the interior of the cavity, towards the electrodes, by moving the mould while the blank of material is being held against the mould by the blank holder.

If the wall that supports the electrodes is stationary, there is no need to move the current-carrying conductors connecting the electrodes to the pulse voltage generator, in which circulate currents of about several tens or hundreds of kA. These current-carrying conductors are therefore heavy, bulky and tend to deteriorate from being moved repeatedly.

In one specific embodiment, the assembly formed by the mould, the blank of material and the blank holder is mounted on a movable plate of a press.

The blank holder is thus directly screwed onto the blank of material and engages with the blank of material.

In another specific embodiment, the assembly formed by the mould and the blank of material is mounted on a movable plate of a press, and the blank holder is mounted on at least one cylinder, a first end of each cylinder being fixed to the bottom wall of the frame, a second end of each cylinder being fixed to the blank holder.

The blank of material is thus positioned on the blank holder and the mould presses against the blank of material. The pressure exerted by the blank holder can thus be regulated in an autonomous manner, independently of the pressure exerted by the mould on the blank holder. This is particularly advantageous if the wall supporting the electrodes is stationary and if the cavity is pressurised by the movement of the assembly formed by the mould and the blank holder towards the interior of the cavity.

In one specific embodiment, the at least one cylinder is a gas spring.

The pressure exerted on the blank of material is thus constant, regardless of the position of the mould in the frame, as long as the mould is in contact with the blank of material.

In one embodiment, the assembly formed by the mould and the blank of material is mounted on a first plate of a press, the frame comprises a movable wall supporting the at least two electrodes mounted on a second movable plate of a press, the second plate of the press preferentially being capable of applying a pressure that exceeds that which can be applied by the first plate of the press.

Advantageously, the two plates of a double acting press can be used to move, firstly, the movable wall of the frame supporting the at least two electrodes in order to pressurise the liquid present in the cavity, and secondly, the mould in order to adjust the pressure exerted on the blank of material. Since the pressurisation of the liquid in the cavity is limited by the force of the press, the plate of the double acting press can be advantageously used to apply a greater force in order to pressurise the liquid by moving the wall supporting the electrodes. A lesser pressure can be used to adjust the pressure exerted on the blank of material.

Advantageously, the frame comprises a portion that is not capable of moving, on which the blank holder is at rest.

The blank holder can rest directly on the non-movable portion of the bottom wall of the frame comprising the electrodes. The blank of material is thus positioned on the blank holder and the mould presses against the blank of material. The pressure exerted by the mould on the blank of material, and thus the pressure exerted on the blank of material, can be adjusted using the plate of the double acting press. The blank holder can also rest indirectly on the non-movable portion of the bottom wall of the frame.

It should be noted that, in other embodiments, all or part of a wall that is different to those comprising the electrodes or formed by the blank of material could be moved. In such a case, the wall is not mounted on a press, but instead constitutes the movable wall of a piston, the cavity thus forming one of the compartments of the piston.

BRIEF DESCRIPTION OF THE FIGURES

The features and advantages of the present invention will be more clearly observed in the following description, which is given with reference to the accompanying figures, in which.

DETAILED DESCRIPTION OF SEVERAL EMBODIMENTS OF THE INVENTION

Figure 1:
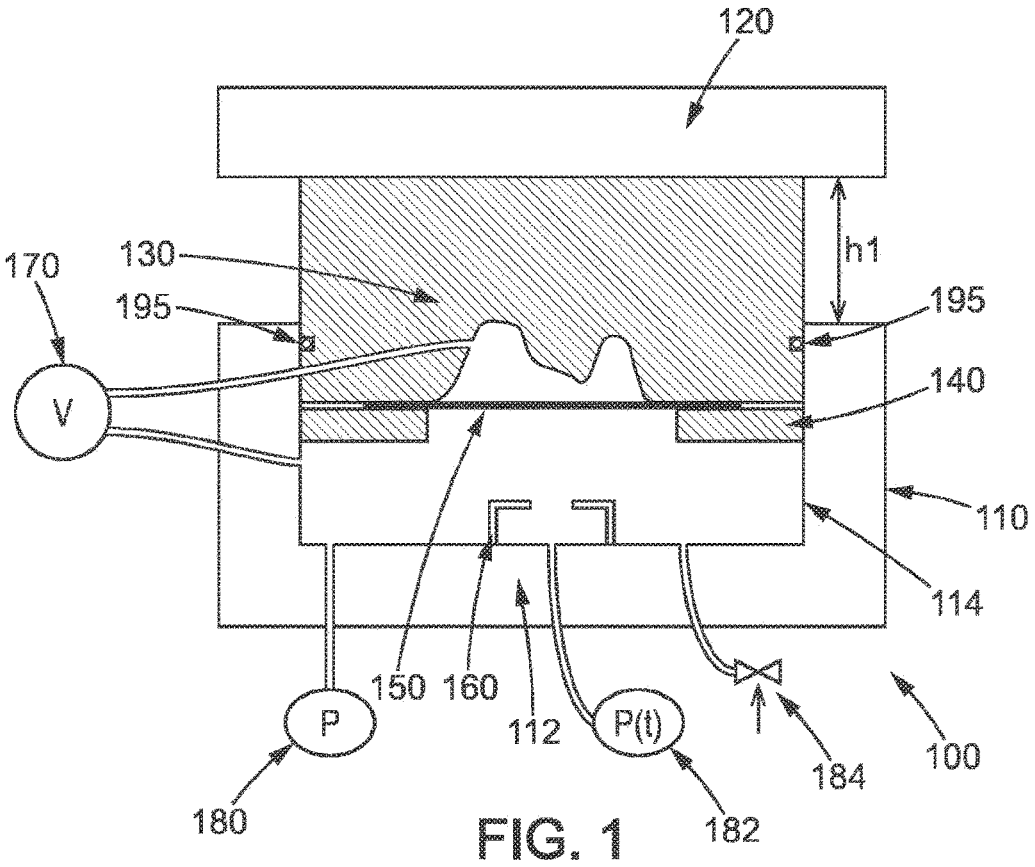
FIGS. 1 to 4 show different steps of an electrohydraulic forming method according to the invention, the method being implemented with an electrohydraulic forming device according to a first embodiment.

FIG. 1 shows an electrohydraulic forming device 100 according to a first embodiment. This electrohydraulic forming device 100 comprises a frame 110 and a movable plate 120 of a press on which a mould 130 is mounted. The plate 120, and thus the mould 130 are capable of moving relative to the frame 110.

A blank of material 150 to be deformed is placed between the mould 130 and a blank holder 140. The blank holder is used to hold the blank of material against the mould 130. In particular, the blank holder is facing the mould, and more particularly one wall of the mould, and engages with the mould in order to hold the blank of material there against. In the embodiment described here, the blank holder 140 is fixed to the mould 130. The blank holder 140 is thus separate from the frame.

The frame 110 comprises a bottom wall 112 and a side wall 114. The bottom wall 112, the side wall 114 and the blank of material 150 define a cavity intended to be filled with a liquid, for example water. The cavity is sealed by sealing means, for example by an O-ring 195 present on one side wall of the mould 130. The cavity is thus sealed between the mould 130 and the side wall of the frame 114.

At least two electrodes 160 are mounted on the bottom wall 112, said electrodes being connected to current-carrying conductors which can, for example, be insulated metal plates or cables (not shown in the figures). These current-carrying conductors can be connected to an electric generator used to generate high-voltage pulses that are sufficient for causing an electric discharge between two electrodes 160. The current-carrying conductors can pass, in a sealed manner, through the walls of the frame or pass over the edges of the walls of the frame.

The electric generator used to generate high-voltage pulses can comprise a plurality of modules that are simultaneously charged and successively discharged by the two electrodes if the electrohydraulic forming operation is carried out using a plurality of successive discharges.

In one alternative embodiment, one of the electrodes is formed by the bottom wall 112 of the frame.

A pumping circuit associated with a pump 180 is used to fill the cavity with liquid. According to the invention, the liquid inside the cavity is pressurised by moving a movable wall of the cavity, in this case the blank of material and more particularly the assembly formed by the mould 130, the blank of material 150 and the blank holder 140. A pressure gauge 182 is used to measure the pressure inside the cavity and can be combined with a regulation system for controlling the pressure inside the cavity. This regulation system can further control the stopping of the movable wall of the cavity, when the pressure measured in the cavity is sufficient for the hydraulic forming of the blank of material 150 against the mould 130.

A vacuum pump 170 is used to create the vacuum in the cavity and in the space between the mould 130 and the blank of material 150 to be deformed. The vacuum created in the cavity prevents air from being present at the interface between the blank of material 150 and the liquid and at the interface between the blank of material 150 and the recess of the mould 130. The efficiency of the hydraulic and electrohydraulic forming operations is thus improved.

In one alternative embodiment, the electrohydraulic forming device 100 comprises a valve associated with a pressure switch 184. The valve associated with the pressure switch reduces the pressure of the liquid in the cavity before the electrohydraulic forming operation. This step reduces the voltage required to generate an electric discharge between the electrodes, which would be higher if the liquid is kept pressurised.

Different steps of an electrohydraulic forming method comprising a hydraulic preforming operation using the above device are described with reference to FIGS. 1 to 4.

In a first step, the blank of material 150 to be deformed is placed between the mould 130 and the blank holder 140, and the blank holder 140 is clamped against the blank of material 150, for example using screws. The cavity containing the electrodes 160 is then filled with liquid or the liquid already present in said cavity is then topped up using the pump 180, while also creating a negative pressure in the cavity using the vacuum pump 170. The negative pressure created facilitates the filling or topping up of the cavity and furthermore reduces the quantity of air present in the cavity and thus improves the efficiency of the electrohydraulic forming operation. The cavity is filled until the blank of material 150 comes into contact with the liquid in the cavity. A vacuum is then created between the blank of material 150 and the mould 130 using the pump 170.

Figure 2:
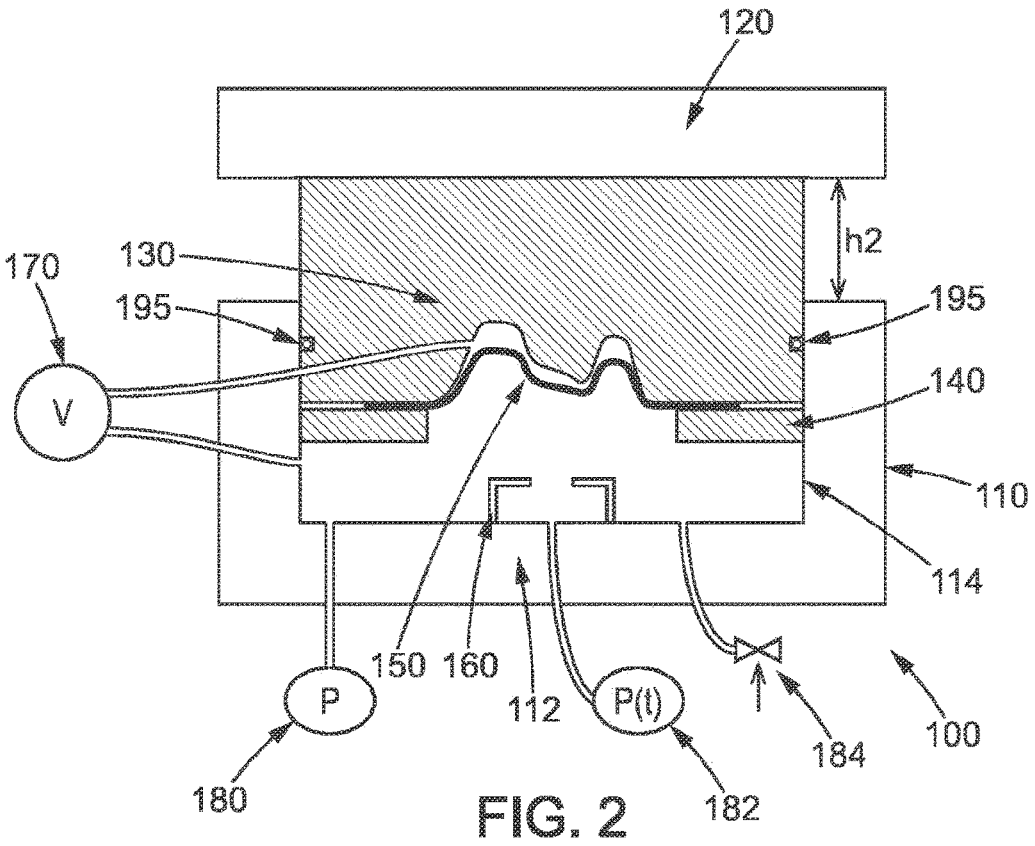

In a second step, shown in FIG. 2, one wall of the cavity, in this case formed by the mould 130, the blank of material 150 and the blank holder 140, is moved towards the interior of the cavity in order to reduce the volume of same. A press is used to increase the pressure of the liquid in the cavity to a predetermined value that is sufficient for the hydraulic preforming of the blank of material 150, the pressure of the liquid in the cavity being, in such a case, limited by the force of the press. The movement of the mould 130 is stopped by the regulation system when the predefined liquid pressure is measured by the pressure gauge 182.

Figure 3:
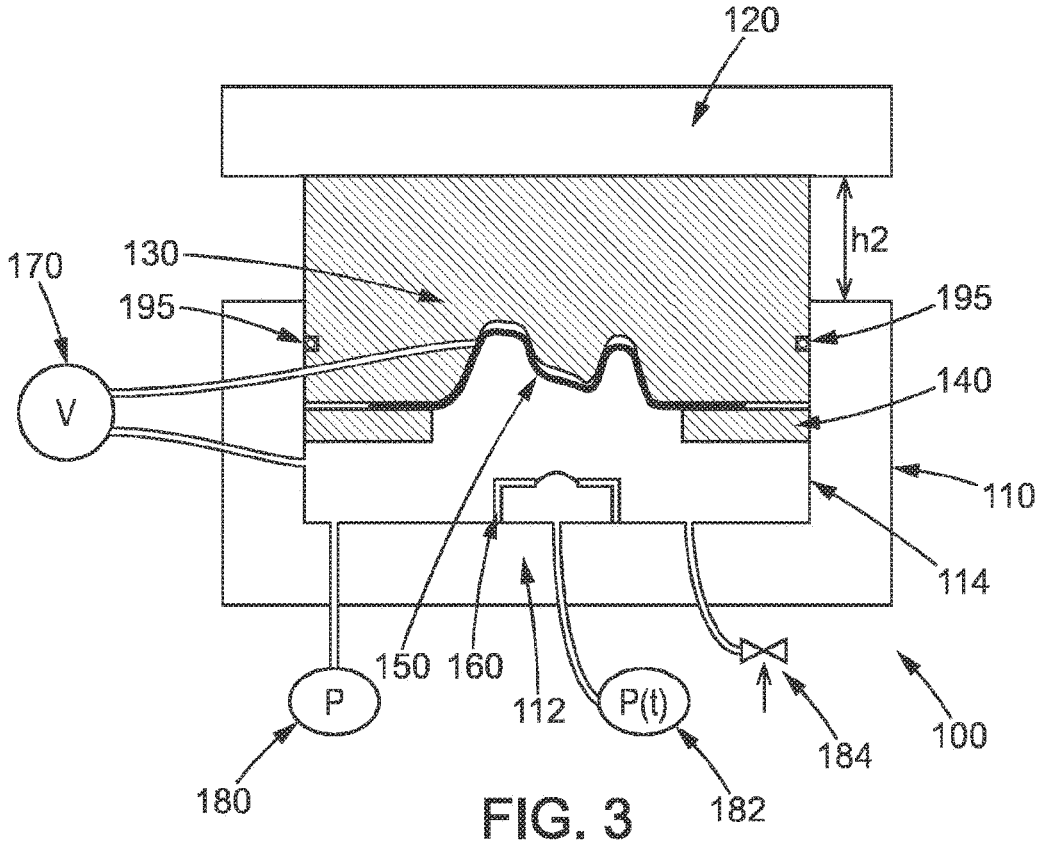
Figure 4:
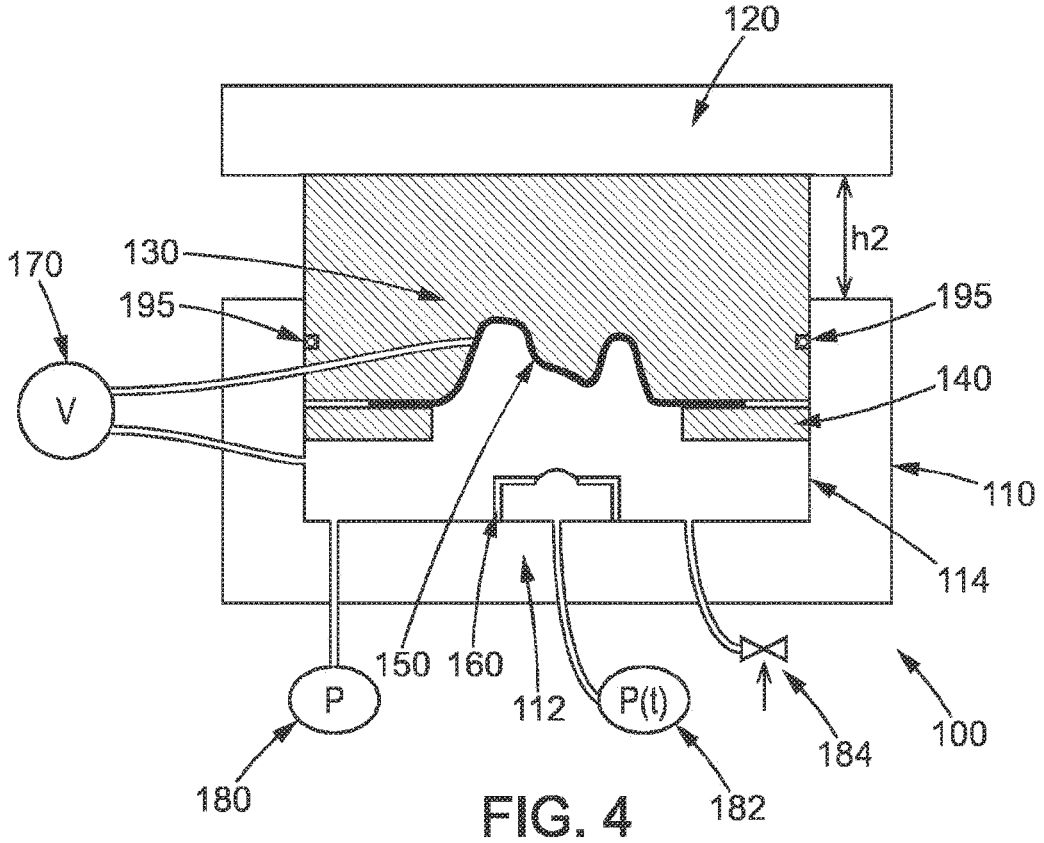

In a third step, shown with reference to FIG. 3, at least one electric discharge is generated between the two electrodes 160 so as to create an electric arc between the electrodes. Since the two electrodes 160 are immersed in a liquid, for example water, the electric arc produces an elevated temperature gradient until the water is vaporised between the electrodes 160. This vaporisation causes a pressure wave, also referred to as a "shock wave" hereafter, propagating in the liquid until it reaches the blank of material 150 to be deformed. Under the effect of the shock wave, the blank of material is deformed against the mould as shown in FIG. 3. If necessary, other electric discharges are generated between the two electrodes 160 until the blank of material adopts the desired shape, as shown in FIG. 4.

In one alternative embodiment, the pressure of the liquid in the cavity is reduced before the electrohydraulic forming operation. The voltage required to generate an electric discharge between the electrodes is thus reduced, which voltage would be higher if the liquid is kept pressurised. This step allows for the use of a less expensive and less bulky electric generator compared to that used in the aforementioned step.

Figure 5:
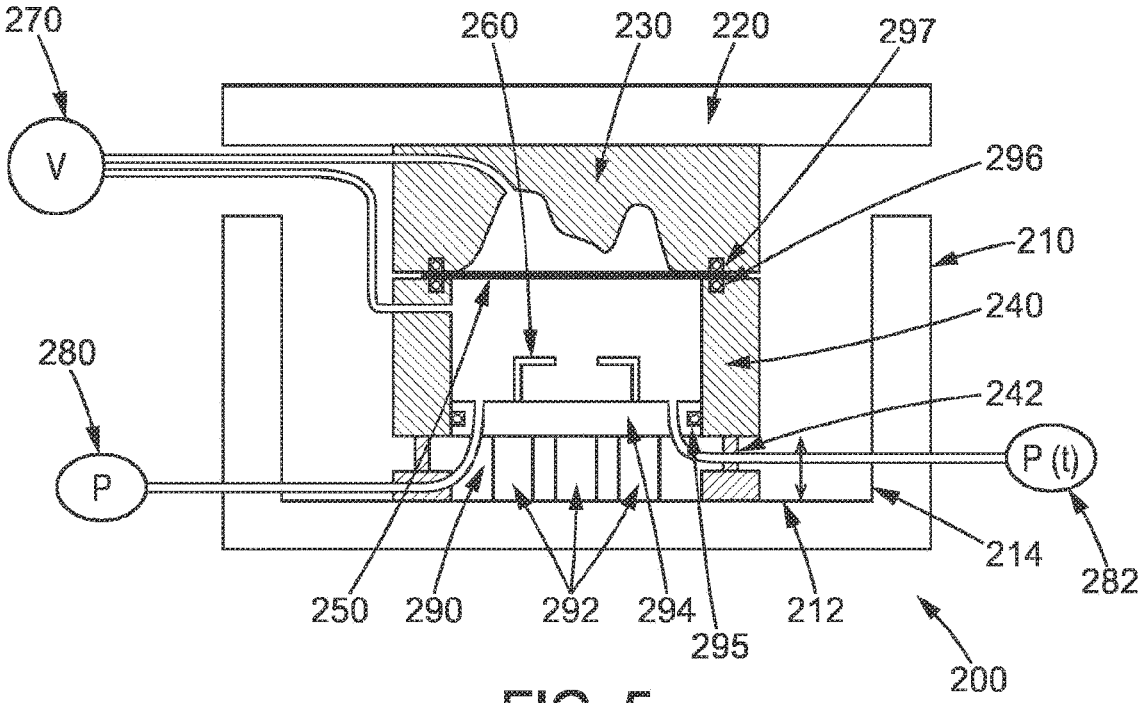
FIG. 5 shows an electrohydraulic forming device according to a second embodiment and an associated electrohydraulic forming method.

FIG. 5 shows a second embodiment of an electrohydraulic forming device 200 that comprises, as in the first embodiment, a frame 210, a moving plate 220 of a press on which a mould 230 is mounted, and a blank holder 240 intended to hold the blank of material 250 to be deformed against the mould 230 by engaging with the mould.

The frame 210 comprises a bottom wall 212 and a side wall 214.

The electrodes 260 are mounted on a baseplate 290 comprising, for example, three legs 292 supporting a base 294. The electrodes 260 are connected, in a sealed manner, through the base 294, to an electric generator used to generate short high-voltage pulses of a high electrical power and sufficient to generate an electrical discharge between two electrodes 260.

In this embodiment, the blank holder 240 extends longitudinally in the frame towards the electrodes parallel to the side wall 214 of the frame 210 and surrounds the electrodes 260. The blank holder 240 is used to reflect a part of the shock wave generated after the electric discharge triggered between the electrodes, which limits the solicitation of the frame. More specifically, if the frame is frequently solicited by the shock waves, it can become fragile, for example at the level of the welds between the different portions thereof if it has a mechanically welded structure. Thus, a frame with walls of a lesser thickness can be used. The blank holder 240 can be mounted on one or more cylinders 242 facing the mould, and more particularly facing one wall of the mould, as shown in FIG. 4, one end of each of these cylinders 242 being fixed to the bottom wall 212 of the frame, and the other end being fixed to the blank holder 240. The blank holder is thus separate from the mould. The pressure exerted on the blank of material 250 by the blank holder 240 is controlled by the one or more cylinders 242, whereby the blank holder 240 presses on the mould.

In one alternative embodiment, the one or more cylinders 242 are gas springs. The pressure exerted on the blank of material is thus constant, regardless of the position of the mould in the frame, as long as the mould is in contact with the blank of material. The baseplate 290, and more particularly the base 294 thereof, the blank holder 240 and the blank of material 250 define a cavity intended to be filled with a liquid, for example water.

A pumping circuit associated with a pump 280 is used to fill the cavity with liquid. Such a cavity has the advantage of being capable of being filled in an optimised manner with a smaller volume of liquid compared to the device described in the first embodiment.

Moreover, the cavity is sealed by the addition of sealing means, for example at least one O-ring 295, for example between the side wall of the base 294 of the baseplate 290 and the inner wall of the blank holder 240. The sealing between the blank holder 240 and the blank of material 250 to be deformed is produced using an O-ring 296 comprised in the upper portion of the blank holder 240 and using an O-ring 297 comprised in the lower portion of the mould, for example. The O-ring 296 is used to provide the seal between the blank of material 250 and the blank holder 240, and the O-ring 297 is used to provide the seal between the blank of material 250 and the mould 230.

As described hereinabove, the vacuum pump 270 is used to create the vacuum in the space between the mould 230 and the blank of material 250, and potentially also to create a negative pressure in the sealed cavity when filling or topping up same.

As described hereinabove, the pressurisation of the liquid in the cavity is carried out using the device described hereinabove by bringing the mould 230 closer to the electrodes 260. The pressure gauge 282 is used to measure the pressure inside the cavity and the regulation system is used to control the stopping of the movable wall of the cavity, when the pressure measured in the cavity is sufficient to allow for the hydraulic forming of the blank of material 250 by applying sufficient quasi-static pressure.

The different steps of the electrohydraulic forming method are similar to those described with reference to FIGS. 1 to 4. However, the blank of material is no longer held against the mould using a blank holder screwed onto the mould. In this embodiment, the blank of material 250 to be deformed is deposited on the blank holder 240, then the mould 230 is lowered in order to press against the blank of material 250 and the blank holder 240. The pressure exerted on the blank of material 250 by the blank holder 240 can be controlled by the one or more cylinders 242, for example by gas springs.

It should be noted that in the embodiments described hereinabove, one wall of the cavity comprising the blank of material is moved, whereby the assembly formed by the blank of material and the mould is mounted on the movable plate of a press. In other words, the blank of material is moved towards the interior of the cavity, towards the electrodes, by moving the mould while the blank of material is being held against the mould by the blank holder.

In the embodiment described with reference to FIGS. 1 to 4, the blank of material is held against the mould by a blank holder mounted on the mould. In the embodiment described with reference to FIG. 4, the blank holder is mounted on a cylinder and engages with the mould in order to hold the blank of material. Thus, the assembly formed by the mould, the blank of material and the blank holder is capable of moving.

In other embodiments, one wall of the cavity supporting the at least two electrodes could be moved using a press.

Figure 6:
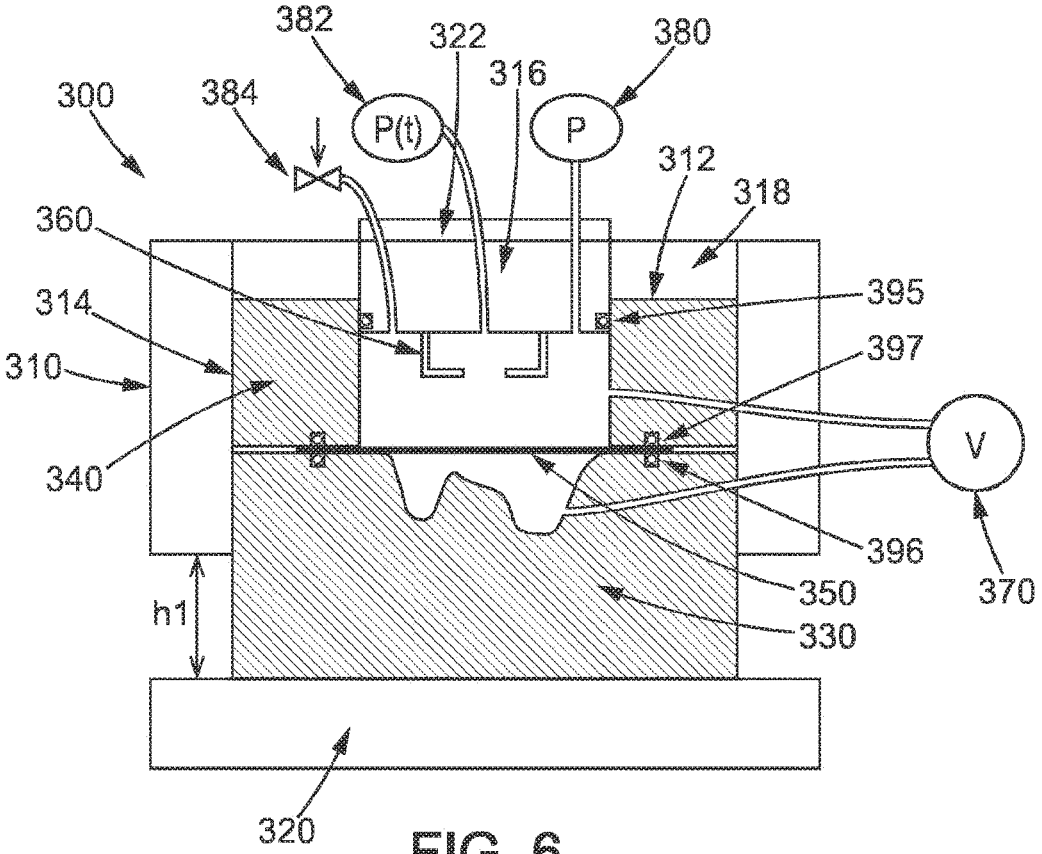
FIG. 6 shows an electrohydraulic forming device according to a third embodiment and an associated electrohydraulic forming method.

FIG. 6 shows one embodiment wherein the portion of the wall of the cavity supporting at least two electrodes is mounted such that it can move.

The electrohydraulic forming device 300 comprises a frame 310, a mould 230 mounted on a first movable plate 320 of a press and a blank holder 340 intended to hold the blank of material 350 to be deformed against the mould 230.

The frame 310 comprises a bottom wall 312 and a side wall 314. The bottom wall 312 comprises a movable wall 316 supporting at least two electrodes 360 and a stationary wall 318. The movable wall 316 is mounted on a second plate 322 of the press. The blank holder 340 is at rest on the portion of the bottom wall 312 that is not movable, i.e. on the stationary wall 318. The blank holder 340 is stationary and is located facing the mould in the cavity formed by the blank holder 340, the movable wall 316 of the frame 310 supporting the electrodes 360 and the blank of material 350 to be deformed.

The cavity is sealed by the addition of sealing means, for example an O-ring 395 contained inside the side wall of the movable wall 316, an O-ring 396 contained inside the portion of the blank holder 340 in contact with the blank of material 350 and an O-ring 397 contained inside the portion of the mould 330 in contact with the blank of material 350. The O-ring 395 can produce the seal between the movable wall 316 supporting the electrodes 360 and the blank holder 240 and potentially the stationary wall 318 of the bottom wall 312 of the frame 310. The O-ring 396 is used to provide the seal between the blank of material 350 and the mould 330, and the O-ring 397 is used to provide the seal between the blank of material 350 and the blank holder 340.

The movement of the movable wall 316 pressurises the liquid in the cavity formed by the blank holder 340, the movable wall 316 of the frame 310 supporting the electrodes 360 and the blank of material 350 to be deformed. The pressure exerted on the blank of material 350 is adjusted using the pressure exerted by the plate 320 of the press when the mould 330 is in contact with the blank of material 350.

As for the other embodiments described hereinabove, the electrohydraulic forming device comprises a pumping circuit associated with a pump 380, a pressure gauge 382 and a vacuum pump 370 as described hereinabove. It can further comprise a valve associated with a pressure switch 384.

The plate of the press capable of providing a pressure that exceeds that of the other plate is mounted preferentially on the movable wall 316 supporting the electrodes 360. More specifically, the force to be provided to pressurise the liquid in the cavity is often greater than the force that is ideally to be exerted on the blank of material.

It should be noted that, when a double acting press is used, the plate capable of providing the strongest force is the upper plate.

The movable wall 316 supporting the electrodes 316 is thus above and the mould 330 is below the blank of material to be deformed 350 as shown in FIG. 6.

The different steps of an electrohydraulic forming method comprising hydraulic preforming with the device described with reference to FIG. 6 are described hereinbelow.

In a first step, the blank of material 350 to be deformed is placed on the mould 330 and the mould 330 is brought closer to the frame 310 until the blank of material is held between the blank holder 340 and the mould 330 with the desired pressure. The blank holder thus engages with the mould in order to hold the blank of material. The cavity partially formed by the frame is then filled using the pump 380, while also advantageously creating a negative pressure in the cavity using the vacuum pump 370. If the movable wall 316 supporting the electrodes 316 is above the blank of material 350 to be deformed, the liquid in the cavity is in contact with the blank of material 350 as soon as the pump 380 is activated to fill the cavity. In such a case, the cavity is filled until the wall 316 supporting the electrodes 360 comes into contact with the liquid in the cavity. A vacuum is then created between the blank of material 350 and the mould 330 using the vacuum pump 370.

In a second step, the movable wall 316 of the cavity supporting the electrodes is moved towards the interior of the cavity so as to reduce the volume of the cavity. The force exerted on the movable wall 316 increases the pressure of the liquid in the cavity until reaching a predetermined value that is sufficient to allow for the hydraulic preforming of the blank of material 350. The movement of the movable wall 316 is stopped by the regulation system when the predefined liquid pressure is measured by the pressure gauge 382.

In a third step, at least one electric discharge is generated between the two electrodes 360 so as to create an electric arc between the electrodes and a "shock wave" propagating in the liquid until it reaches the blank of material 350 to be deformed. Under the effect of the shock wave, the blank of material is deformed against the mould. If necessary, other electric discharges are generated between the two electrodes 360 until the blank of material adopts the desired shape.

As described hereinabove, the pressure of the liquid in the cavity can be reduced using a valve associated with a pressure switch 184 before the electrohydraulic forming operation. It should be noted that, in the embodiments described herein, one wall of the cavity comprising the blank of material or one wall supporting the electrodes are moved. Moreover, all or part of a wall that is different to those supporting the electrodes or formed by the blank of material could also be moved. In such a case, the wall is not mounted on a press, but instead constitutes the movable wall of a piston, the cavity thus forming one of the compartments of the piston.

The various embodiments of an electrohydraulic forming device and the forming methods described hereinabove allow the liquid in the cavity to be pressurised more quickly than when using a pressurised pump, the flow rate whereof is limited. Moreover, there is no need to refill the vessel with the pressurised liquid between each part forming cycle. This results in reduced cycle times. Moreover, the equipment to be used is less complex as there is no need to generate pressurised water.

The present invention is not limited to the different embodiments described and shown and to the alternative embodiments mentioned; it also relates to the embodiments within reach of a person skilled in the art within the scope of the claims hereafter.

The invention claimed is:

1. A method, comprising:

placing a blank of material between a mould and a blank holder, the mould mounted on a movable plate of a press, the blank holder mounted on at least one cylinder, a first end of the at least one cylinder being fixed to a bottom wall of a frame, a second end of the at least one cylinder being fixed to the blank holder;

filling a sealed cavity containing electrodes with liquid to a predetermined liquid level;

placing the blank of material in contact with the liquid in the cavity;

hydraulically preforming the blank of material, the hydraulically preforming including pushing the blank of material towards the mould by the liquid in the cavity, the blank of material thereby undergoing a first deformation; and electrohydraulically forming the blank of material, the electrohydraulically forming including pressing the blank of material against the mould by at least one pressure wave generated by an electric discharge between the electrodes, the blank of material thereby undergoing a second deformation, wherein the hydraulic preforming includes pressurizing the liquid in the cavity by displacing all or part of a wall of the cavity.

2. The method according to claim 1, further comprising creating a vacuum between the blank of material and the mould after the blank of material is placed in contact with the liquid in the cavity.

3. The method according to claim 1, wherein pressurizing the liquid in the cavity includes moving an assembly formed by the mould and the blank of material towards an interior of the cavity.

4. The method according to claim 3, wherein moving the assembly formed by the mould and the blank of material includes moving the assembly while the electrodes are stationary.

5. The method according to claim 1, wherein pressurizing the liquid in the cavity includes moving the wall, which includes the electrodes, towards the interior of the cavity.

6. An electrohydraulic forming device for electrohydraulically forming a blank of material comprising:

a frame;

a mould mounted on a first movable plate of a press;

a blank holder configured to hold the blank of material against the mould and cause the blank of material to form at least part of one wall of a sealed cavity configured to be filled with a liquid;

at least one cylinder on which the blank holder is mounted, a first end of each cylinder being fixed to a bottom wall of the frame, a second end of each cylinder being fixed to the blank holder; and plural electrodes placed inside the cavity, wherein:

the cavity comprises at least one movable wall, and the movement of the movable wall is capable of pressurizing the liquid in the cavity to a sufficient degree to generate a deformation of the blank of material against the mould.

7. The electrohydraulic forming device according to claim 6, further comprising a vacuum pump configured to create a vacuum between the mould and the blank of material.

8. The electrohydraulic forming device according to claim 6, wherein the cavity is at least partly formed by the frame.

9. The electrohydraulic forming device according to claim 8, further comprising a baseplate that supports the electrodes and rests on the bottom wall of the frame.

10. The electrohydraulic forming device according to claim 6, wherein the blank holder is separate from the frame, and extends longitudinally in the frame towards the electrodes.

11. The electrohydraulic forming device according to claim 6, wherein the movable wall comprises the blank of material, and an assembly formed by the mould and the blank of material is mounted on the first movable plate of the press.

12. The electrohydraulic forming device according to claim 6, wherein an assembly formed by the mould, the blank of material and the blank holder is mounted on the first movable plate of the press.

13. The electrohydraulic forming device according to claim 6, wherein:

an assembly formed by the mould and the blank of material is mounted on the first movable plate of a press, and the movable wall supports the electrodes and is mounted on a second movable plate of the press, the second movable plate of the press being capable of applying a pressure that exceeds a pressure which can be applied by the first movable plate of the press.

14. The electrohydraulic forming device forming device according to claim 13, wherein the frame comprises a portion that is not capable of moving, on which the blank holder is at rest.

* * * * *